United States Patent [19]

Baslow

[11] 4,201,359

[45] * May 6, 1980

[54] FABRIC-COVERED CHAIR RAIL

[76] Inventor: Floyd M. Baslow, 100 Lafayette St., New Bethlehem, Pa. 16242

[ * ] Notice: The portion of the term of this patent subsequent to Apr. 19, 1994, has been disclaimed.

[21] Appl. No.: 758,203

[22] Filed: Jan. 10, 1977

Related U.S. Application Data

[63] Continuation-in-part of Ser. No. 680,703, Apr. 27, 1976, Pat. No. 4,018,260.

[51] Int. Cl.[2] ..... E04F 19/02; A47B 95/00

[52] U.S. Cl. ..... 248/345.1; 52/716; 160/392

[58] Field of Search ..... 248/345.1; 52/716, 222, 52/273; 160/327, 394, 395, 392

[56] References Cited

U.S. PATENT DOCUMENTS

| | | | |
|---|---|---|---|
| 1,864,477 | 6/1932 | Stannard | 160/395 |
| 3,679,505 | 7/1972 | Hinderaker et al. | 160/354 |
| 3,825,229 | 7/1974 | Bartlett et al. | 52/716 |
| 3,895,468 | 7/1975 | Bernstein | 160/395 |
| 3,928,897 | 12/1975 | Tombu | 160/392 |
| 3,991,537 | 11/1976 | Brown | 248/345.1 |
| 4,018,260 | 4/1977 | Baslow | 52/288 |

*Primary Examiner*—James L. Ridgill, Jr.
*Attorney, Agent, or Firm*—Michael Ebert

[57] ABSTRACT

A fabric-covered chair rail for creating a horizontal waistline along the interior walls of a room or passage that is both protective and decorative. The chair rail for a given interior is formed by pieces whose lengths are appropriate to the interior walls. Each piece is constituted by a molding having upper and lower edges which are separated from the base to define therewith inlet jaws communicating with an internal storage channel running the full length of the molding. Overlying the molding whose base abuts the wall to be railed and conforming to the contour thereof is a replaceable band of fabric having upper and lower margins which initially extend beyond the edges of the molding. The fabric margins are inserted in the jaws of the upper and lower edges of the molding and are stuffed into the storage channels whereby the fabric fully covers the exposed portion of the molding and presents a smooth and attractive appearance.

7 Claims, 9 Drawing Figures

FABRIC-COVERED CHAIR RAIL

RELATED APPLICATION

This application is a continuation-in-part of my copending application Ser. No. 680,703, filed Apr. 27, 1976, now U.S. Pat. No. 4,018,260, issued Apr. 19, 1977 entitled "Fabric Wall Coverings".

BACKGROUND OF THE INVENTION

This invention relates generally to fabric-covered chair rails, and more particularly to a chair rail whose pieces are formed by a molding covered by a replaceable band of fabric that need not be precisely cut to size and yet serves to fully and smoothly cover the molding.

In rooms, halls, vestibules and other interiors whose walls are panelled with wainscoting, it is customary to provide a chair rail which creates a horizontal waistline and acts as a buffer to protect the fine woodwork from the backs of chairs or other articles of furniture placed against the panelling. Protection by means of chair rails is even more important when interior walls are lined with costly and relatively delicate fabric material.

The traditional chair rail is formed by a wooden molding attached to the walls around the room or other interior. While the primary purpose of a chair rail is functional to provide a protective bumper, because it produces a horizontal waistline, it has the effect of making the room appear larger and lower. It is for this reason that chair rails are often found in bedrooms, dining rooms, hallways, as well as in living rooms. Moreover, the use of chair rails is not limited to panelled or fabric-covered walls, for such rails may be installed on the advice of interior decorators on painted or papered walls to add a purely decorative touch thereto.

With a conventional wooden chair rail, the decorative possibilities are limited to the color and contour of the rail, and one cannot change this color without repainting or repapering the wood. Thus should a householder make a major design change in the decor of a particular room, the existing design of the chair rail may not be properly coordinated with the new decor.

SUMMARY OF INVENTION

In view of the foregoing, it is the main object of this invention to provide a fabric-covered chair rail which is attachable to the walls of an interior and includes a replaceable band of fabric whereby the covering may be readily changed when it is soiled or damaged or to suit the decor of the room.

More particularly, it is an object of this invention to provide a fabric-covered chair rail that includes a molding formed of extruded synthetic plastic material which may be mass-produced at low cost, the molding having longitudinally-extending internal channels adapted to receive the margins of a fabric band overlying the molding and conforming thereto.

A significant feature of the invention is that the moldings provide rough tolerances for the dimensions of the fabric band to be secured thereto; for as long as the width of the conforming band is such as to produce margins which extend beyond the upper and lower edges of the molding, these margins, regardless of their breadth (within certain limits), may be stuffed into the internal channels and concealed thereby. Hence the cutting of fabric bands to size is not a critical operation, and an ordinary householder, with no particular skill in handling fabrics, is in a position to cut the fabric bands without fear of making a serious mistake in sizing.

Another advantage of the invention is that the margins of the fabric band may be stuffed into the storage channels by means of a simple tool which requires no special skill or training to handle, so that the band may be mounted on the molding quickly and without difficulty, or readily removed therefrom for cleaning or replacement.

Yet another object of the invention is to provide a molding having an insert strip of flexible foam plastic padding which is covered by the fabric to create a cushioned chair rail producing a more effective protective bumper action. Thus the fabric-covered chair rail in accordance with the invention may be used as a safety rail in a gymnasium.

Briefly stated, these objects are attained in a chair rail which is constituted by pieces whose lengths are appropriate to the walls of the interior in which the rail is to be installed. Each piece includes a molding of extruded synthetic plastic material having upper and lower edges, each separated from the base and defining therewith inlet jaws communicating with an internal storage channel running the full length of the molding.

Overlying the molding whose base abuts the wall to be railed and conforming to the contour thereof is a replaceable band of fabric having upper and lower margins that initially extend beyond the edges of the molding, the margins being inserted in the jaws of the upper and lower edges and being tucked into the storage channels whereby the fabric fully covers the exposed portion of the molding and presents a smooth and attractive appearance.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

First Embodiment

Figures 1, 2, 3A, 3B, 4, 5:
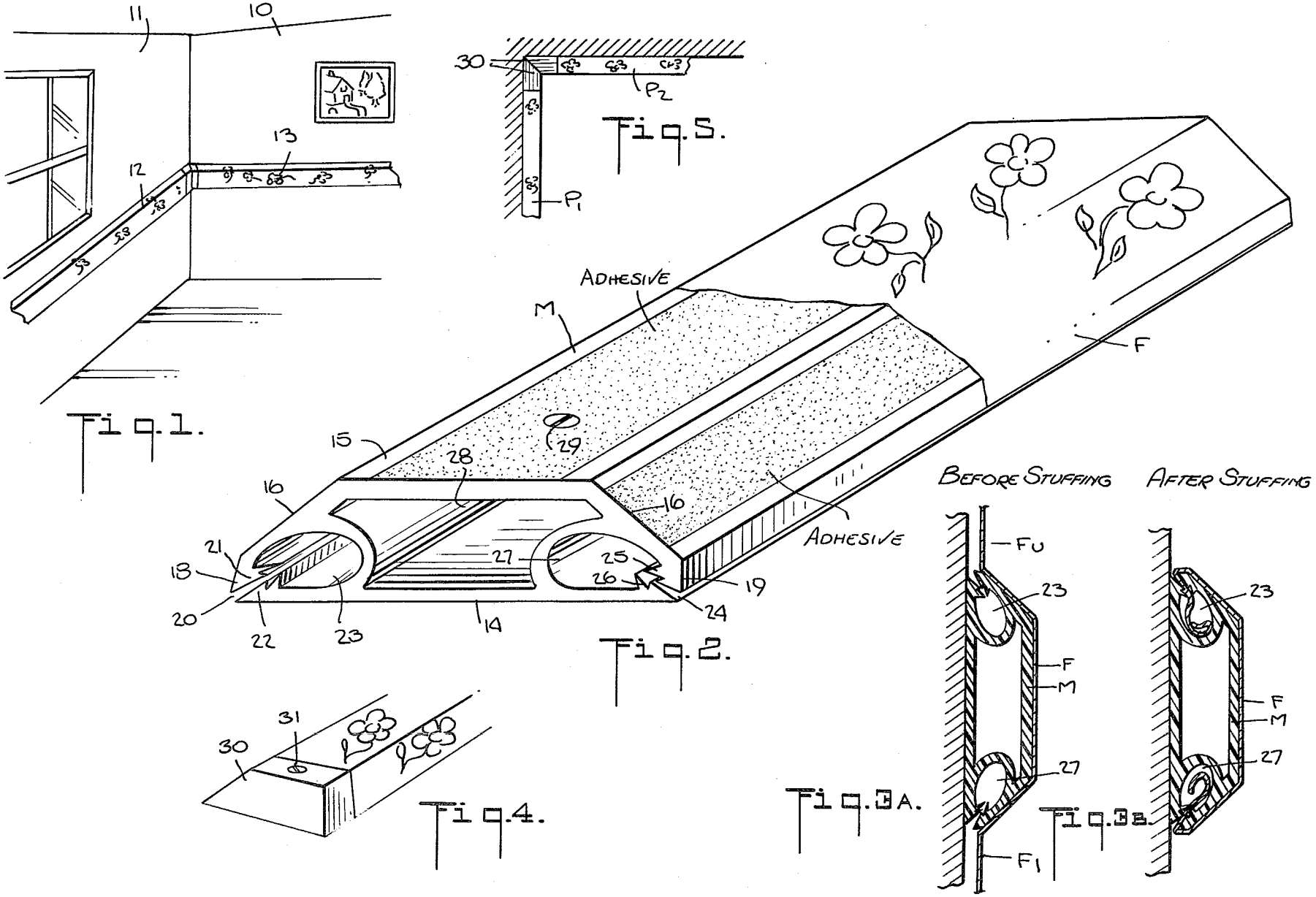
FIG. 1 illustrates a fabric-covered chair rail in accordance with the invention installed in a room.
FIG. 2 is a perspective view of one piece of a preferred embodiment of the chair rail, with its fabric cover partly cut away to expose the underlying molding.
FIG. 3A is a transverse section taken through the piece before the margins of the fabric cover are stuffed into molding channels.
FIG. 3B is the same as FIG. 3A, but after the margins are stuffed into the channels.
FIG. 4 shows an end cap mounted on the end of the piece.
FIG. 5 is a plan view of a chair rail corner formed by two pieces having end caps thereon.

Referring now to FIG. 1, there is shown a rectangular room having interior walls 10 and 11 at right angles to each other. Installed in this room is a fabric-covered chair rail in accordance with the invention, the rail including pieces 12 and 13 mounted at an appropriate height on walls 10 and 11, respectively, the length of each piece corresponding to that of its associated wall. The wall itself may be painted, papered or fabric-covered.

Each piece of the chair rail is composed, as shown in FIG. 2, of a molding M formed of extruded synthetic plastic material having some degree of resilience, such as polyvinyl chloride, polypropylene or polyethylene material. In practice, these extrusions may be made in long stock lengths and thereafter cut on the job site to meet particular wall requirements. If, for example, moldings M are made in stock 10-foot lengths, and a wall on which a piece is to be installed is 15 feet long, the piece in this instance may be made up of one stock 10-foot length plus a 5-foot length cut from a stock length.

Molding M has a generally trapezoidal cross-section defined by a flat base 14, a raised flat face 15 parallel to the base and a pair of inclined sides 16 and 17 which slope downwardly from the face 15 to the upper and lower edges 18 and 19, respectively.

Edge 18 is separated from base 14 by a longitudinally extending slot 20 to form therewith a pair of cooperating jaws 21 and 22 of an inlet communicating with an internal storage channel 23. This channel runs the full length of the molding adjacent the upper edge thereof. The jaws which, because of the nature of the plastic material are somewhat resilient, can therefore be dilated to receive the margin of a fabric band inserted therebetween. The complementary surfaces of jaws 21 and 22 are serrated to resist the withdrawal of the fabric margin gripped thereby.

In a like manner, lower edge 19 is separated from base 14 by a longitudinally-extending slit 24 to define therewith the cooperating jaws 25 and 26 of an inlet communicating with an internal channel 27 running the full length of the molding adjacent the lower edge thereof. The space 28 between the parallel channels 23 and 27 in the molding is hollow to reduce material costs.

The molding may be attached with its base 14 against the wall by means of screws 29, by an epoxy bonding agent or whatever means are appropriate to the wall.

Fabric F covering molding M is formed by a band of material of any selected quality, color and pattern, and for this purpose any knitted, woven or otherwise-formed fabric may be used. The length of fabric band F is made substantially equal to the length of the molding. However, since the ends of the band are covered by end caps, the band length is not critical and may be slightly shorter than the length of the molding.

The width of fabric band F is such that, as shown in FIG. 3A, when it overlies molding M and conforms thereto, its upper and lower margins $F_u$ and $F_l$ initially project beyond the upper and lower edges of the molding. To insure that the fabric band smoothly conforms to the surface of the molding, the face 15 and the inclined sides 16 and 17 thereof are provided with pressure-sensitive adhesive layers. Thus in applying the band to the molding, one first presses and smooths out the central zone of the fabric band F against the face 15 to properly seat the band on the molding, and then the side zones of the fabric are pressed against the sides of the molding and smoothed out, with the upper and lower margins $F_u$ and $F_l$ extending outwardly from the edges of the molding.

The width of fabric band F is not critical, for the margins are stuffed into storage channels 23 and 27, and as long as the margins are broad enough to go into these channels but not so broad as to overtax the capacity of the channels, the fabric width will be acceptable.

The tool by which the fabric margins are stuffed into the channels may be the type disclosed in the above-identified copending patent application and preferably takes the form of a flexible, flat blade similar to a putty knife, except that its forepart is curved downwardly, thereby adapting the blade to push the margin around the edge of the molding between the expansible jaws of the inlet and then into the storage channel.

Thus, as shown in FIG. 3B, the fabric, when in place, entirely covers the exposed portions of the molding (i.e., the face, the sides and the edges) and appears to ensheath the molding. Actually, of course, the fabric does not go behind the base of the molding, but it appears to do so; for the fabric margins, when bending around the edges of the molding, then engage the surface of the wall on which the molding is mounted, and one looking at the fabric-covered molding cannot see that the margins of the fabric are stuffed in the internal storage channels.

In practice, the opposite ends of the fabric band may be finished with a hem or bead, or the band may be left unfinished and covered, as shown in FIG. 4, by an end cap 30 attached to the end of the molding by a screw 31. When, as shown in FIG. 5, two ends of chair rail pieces $P_1$ and $P_2$ attached to walls at right angles to each other meet at the corner of a room, these pieces are provided with corner end caps 30 which are angled at 45° to produce a 90° corner fitting.

Second Embodiment

Figures 6, 7, 8:
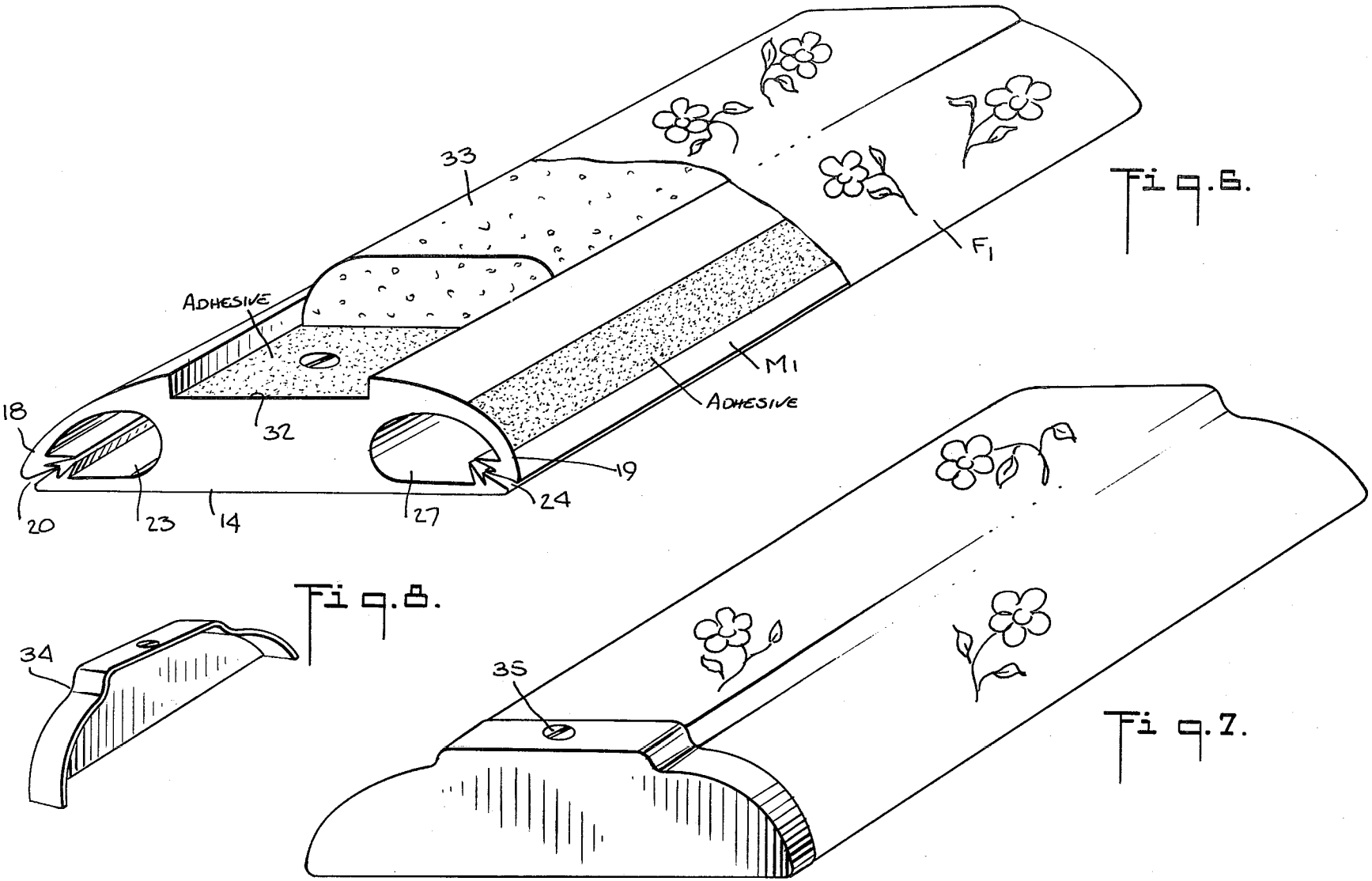
FIG. 6 is a perspective view of a second embodiment of a piece of chair rail, with the fabric cut away to expose the molding.
FIG. 7 shows the same piece with the end cap in place.
FIG. 8 is a separate view of the end cap.

In the second embodiment of the invention shown in FIGS. 6, 7 and 8, the extruded molding M′ has a convex cross-sectional form to provide a curved arch between the upper and lower edges 18 and 19. As in the case of FIG. 2, these edges are separated from base 14 of the molding by slits 20 and 24 to define jaw-like inlets leading into internal storage channels 23 and 27.

However, in this embodiment, the molding is so shaped that formed on its face is a longitudinally-extending trough 32 adapted to receive a strip 33 of a flexible foam plastic padding formed of polyurethane or any other suitable foam plastic material. The bed of trough 32 is coated with a layer of pressure-sensitive adhesive to retain the strip therein. In practice, all surfaces of the molding which are to be rendered pressure-sensitive to secure a foam plastic strip or a fabric bond thereto may be provided with a double-faced pressure-sensitive adhesive tape having a protective release sheet which is stripped off before use, one face engaging the molding and the other the pad or fabric to be adhered thereto.

In this embodiment, fabric band $F_1$ is mounted on the molding by stuffing its margins in the storage channels in the same manner as described previously in connection with the first embodiment, the fabric conforming to the contour of the molding, as modified by the foam plastic strip. Because this strip forms a backing pad for the fabric, the resultant chair rail has cushion-like characteristics which are of practical value in an installation in which physical contact with the wall often occurs, as in a gymnasium or play room. In this instance, the fabric cover need not be decorative and may be a band of canvas, sheet plastic or other high-strength material which resists wear and abuse.

To finish the end of the chair rail piece, an end cap 34 is provided, as shown in FIGS. 7 and 8, which conforms to the shape of the molding as modified by the pad and is secured thereto by a removable screw 35.

It will be appreciated that the contours shown in the moldings included in the first and second embodiments are but two of many design possibilities, and that in practice the cross-sectional form of the molding may take many other shapes, depending on whether the protective or decorative aspects of the rail are to be stressed. Also, especially when the chair rail is installed in a long corridor, use may be made of a fluorescent fabric covering to provide a luminescent guide line when the lights are turned off. Furthermore, instead of using the pieces to form a fabric-covered chair rail, the pieces may be assembled into a rectangular frame to provide a fabric-covered picture frame.

While there have been shown and described preferred embodiments of a fabric-covered chair rail in accordance with the invention, it will be appreciated that many changes and modifications may be made therein without, however, departing from the essential spirit thereof. Thus instead of using a conventional fabric to cover the molding, use may be made for this purpose of a paper or plastic band of sufficient strength and flexibility to permit the margins thereof to be stuffed into the channels, which paper or plastic band may be printed with multi-colored decorative patterns or design motifs. It is not essential that the chair rail be mounted horizontally on a wall, and one may, by the use of vertically mounted moldings in combination with horizontally mounted moldings, create lattice-like and other design effects.

Another protective application for the fabric-covered chair rail is on a wall behind a door, the rail in this instance acting as a door bumper. Also, one may use as fabric bands for the moldings of a chair rail, the waste trimmings from wall-to-wall carpeting laid down in a room, and thereby provide a decorative room accent. Moreover, one can frame a window with chair-rail molding pieces, and instead of covering the pieces with fabric, stretch a clear plastic sheet across the window and anchor the margins of the sheet in the outer storage channels of the frame and thereby create a storm window.

In the molding illustrated in FIG. 6, a foam-plastic padding strip is seated in and adhered to a trough to afford a cushioning action. A functionally equivalent structure may be attained by concurrently extruding the molding plastic and an elastomeric plastic to form a composite structure in which the elastomeric plastic which has cushioning properties is integral with the molding and serves the same purpose as the foam plastic padding.

I claim:

1. A fabric-covered chair rail for creating a horizontal waistline along the interior walls of a room or passage, said rail being constituted by pieces whose lengths are appropriate to the walls, each piece comprising:

a. a one-piece molding attachable to a wall and having upper and lower edges which are separated from a base to define therewith inlet jaws communicating with an internal storage channel running the full length of the molding, said molding being formed of extruded material having sufficient resilience to render said jaws dilatable, said base abutting said wall;

b. a replaceable band of fabric overlying the molding and conforming to the contour thereof, said fabric having upper and lower margins which initially extend beyond the edges of the molding, the fabric margins being inserted in said inlet jaws and being stuffed into said channels whereby the fabric fully covers the exposed portions of the molding and presents a smooth and attractive appearance; and c. a layer of pressure-sensitive adhesive on said molding adjacent the upper and lower edges thereof to secure said fabric thereto.

2. A chair rail as set forth in claim 1, wherein said molding has a trapezoidal cross-section to define a flat face and inclined sides sloping toward said upper and lower edges.

3. A chair rail as set forth in claim 1, wherein said jaws are provided with complementary serrations to resist withdrawal of said margins.

4. A chair rail as set forth in claim 1, further including end caps attached to the ends of said pieces.

5. A chair rail as set forth in claim 1, wherein said molding includes a longitudinally-extending trough within which is received a strip of flexible foam plastic padding which is covered by said fabric and forms a cushion therewith.

6. A chair rail as set forth in claim 5, wherein said molding has a generally convex cross-section.

7. A chair rail as set forth in claim 5, wherein said fabric is canvas.

* * * * *